US010470580B1

(12) United States Patent
Shirley

(10) Patent No.: US 10,470,580 B1
(45) Date of Patent: Nov. 12, 2019

(54) ALL-TERRAIN LOUNGE CHAIR

(71) Applicant: Dwight Shirley, Santee, CA (US)

(72) Inventor: Dwight Shirley, Santee, CA (US)

( * ) Notice: Subject to any disclaimer, the term of this patent is extended or adjusted under 35 U.S.C. 154(b) by 0 days.

(21) Appl. No.: 16/403,098

(22) Filed: May 3, 2019

Related U.S. Application Data

(60) Provisional application No. 62/769,164, filed on Nov. 19, 2018.

(51) Int. Cl.
*A47C 9/10* (2006.01)
*A47C 4/30* (2006.01)

(52) U.S. Cl.
CPC ..... *A47C 9/105* (2013.01); *A47C 4/30* (2013.01)

(58) Field of Classification Search
CPC ..... A47C 9/105; A47C 4/30
USPC ..... 297/451.4, 4
See application file for complete search history.

(56) References Cited

U.S. PATENT DOCUMENTS

| | | | | |
|---|---|---|---|---|
| 4,421,356 | A | 12/1983 | Singer | |
| 7,374,237 | B2 | 5/2008 | Park et al. | |
| 7,654,611 | B1 * | 2/2010 | Kesrouani | A47C 4/04 297/45 |
| 7,931,340 | B1 * | 4/2011 | Reddick | A47C 13/005 297/445.1 |
| 8,894,139 | B1 | 11/2014 | Coffey | |
| 9,095,216 | B2 | 8/2015 | Miller | |
| 9,351,578 | B2 | 5/2016 | Homans et al. | |
| 2008/0238156 | A1 * | 10/2008 | Miyakawa | A47B 85/06 297/19 |
| 2016/0113402 | A1 | 4/2016 | Lee | |

* cited by examiner

*Primary Examiner* — Anthony D Barfield
(74) *Attorney, Agent, or Firm* — Global Intellectual Property Agency, LLC; Daniel Boudwin

(57) ABSTRACT

An all-terrain lounge chair. The lounge chair includes a plurality of legs and a pair of cross bars connecting the legs. The legs are formed such that they may meet at an apex. The apex defines a point that enters the ground. The chair further includes a flexible seat that is attached to the plurality of legs. The chair can be folded from an open position to a closed position.

5 Claims, 4 Drawing Sheets

ALL-TERRAIN LOUNGE CHAIR

CROSS REFERENCE TO RELATED APPLICATIONS

This application claims the benefit of U.S. Provisional Application No. 62/769,164 filed on Nov. 19, 2018. The above identified patent application is herein incorporated by reference in its entirety to provide continuity of disclosure.

BACKGROUND OF THE INVENTION

The present invention relates to all-terrain lounge chairs. More particularly, the present invention provides an all-terrain lounge chair that is light weight and portable.

Many people enjoy hiking, camping, hunting, and all manner of outdoor activities. Many of these actives either require a chair, or would be made much more enjoyable with a chair. Standard outdoor chairs, while effective, may frequently be uncomfortable and unstable. Outdoor chairs may wobble or lean, especially when placed on soft ground surfaces. Sitting on uneven and unstable chairs can cause aches and pains in the neck and back. Some chairs have adjustable legs and can be made to sit level on uneven ground. Inevitably, the lower leg sinks into the ground and becomes un-level and uncomfortable. Accordingly, a chair with all legs converging to a central point allow a person to sit balanced over the center of the chair, even on uneven terrain is desired.

Consequently, there is a need in for an improvement in the art of portable chairs. The present invention substantially diverges in design elements from the known art while at the same time solves a problem many people face in finding and using a light weight and portable chair. In this regard the present invention substantially fulfills these needs.

SUMMARY OF THE INVENTION

The present invention provides an all-terrain lounge chair wherein the same can be utilized for providing convenience for the user when camping, hiking, hunting, or going to a sporting event. The present system comprises a plurality of legs and a pair of cross bars connecting the legs. The legs are formed such that they may meet at an apex. The apex can be sharp and enter the ground. In an alternative embodiment, the legs may meet at an angle. The chair further comprises a flexible seat that is attached to the plurality of legs. The chair can be folded from an open position to a closed position Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
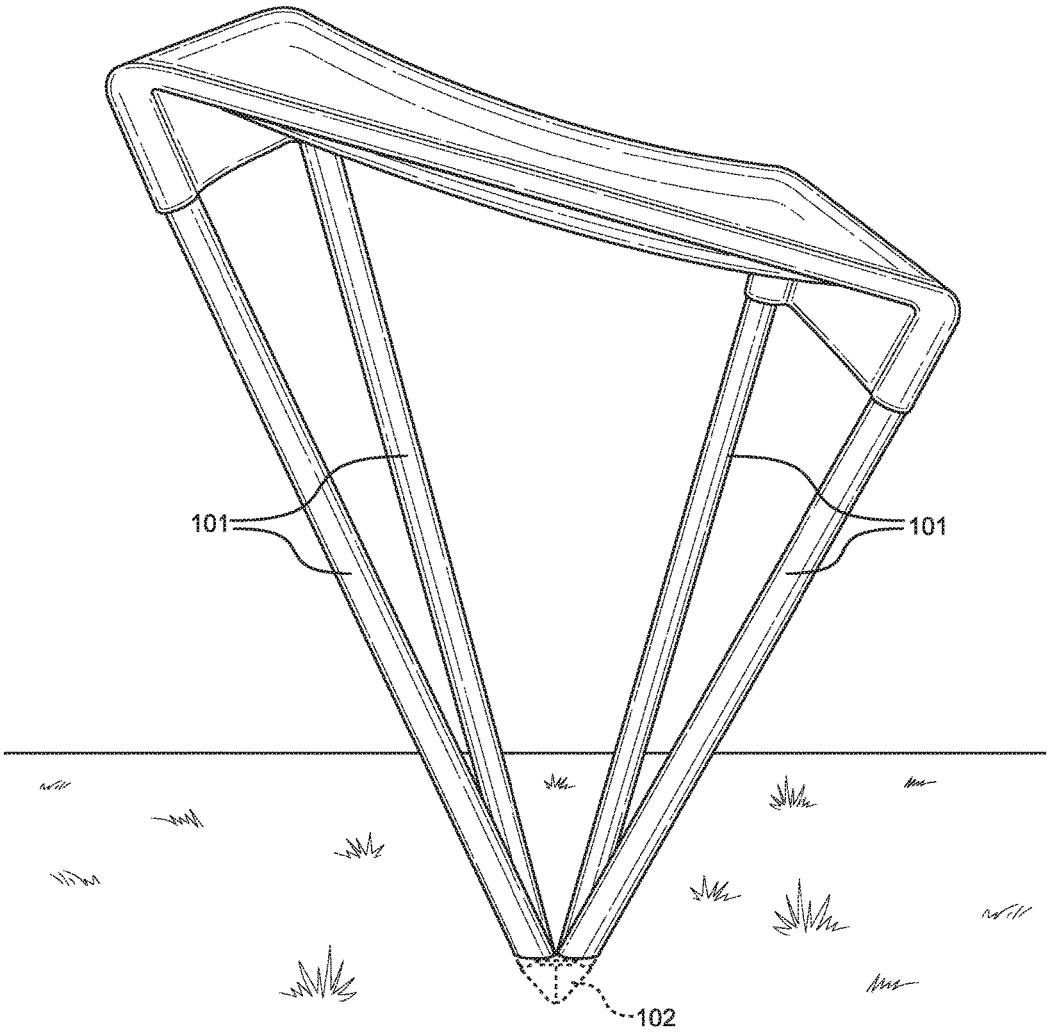
FIG. 1 shows a side view of an embodiment of the all-terrain lounge chair in an open configuration.

Reference is made herein to the attached drawings. Like reference numerals are used throughout the drawings to depict like or similar elements of the all-terrain lounge chair. For the purposes of presenting a brief and clear description of the present invention, a preferred embodiment will be discussed as used for the all-terrain lounge chair. The figures are intended for representative purposes only and should not be considered to be limiting in any respect.

Referring now to FIG. 1, there is shown a side view of an embodiment of the all-terrain lounge chair in an open configuration. is the all-terrain lounge chair comprises a plurality of legs 101 that meet at an apex 102. The legs from the supports for the chair. In one embodiment the supports are triangular. In this embodiment the apex 102 of the triangles is at the lower end of the triangles.

The legs 101 are movably attached together at the apex 102. There is a seat attached to the legs. In the illustrated embodiment, the seat is made from a flexible material. In an embodiment the seat may be stitched onto the legs.

Figure 2:
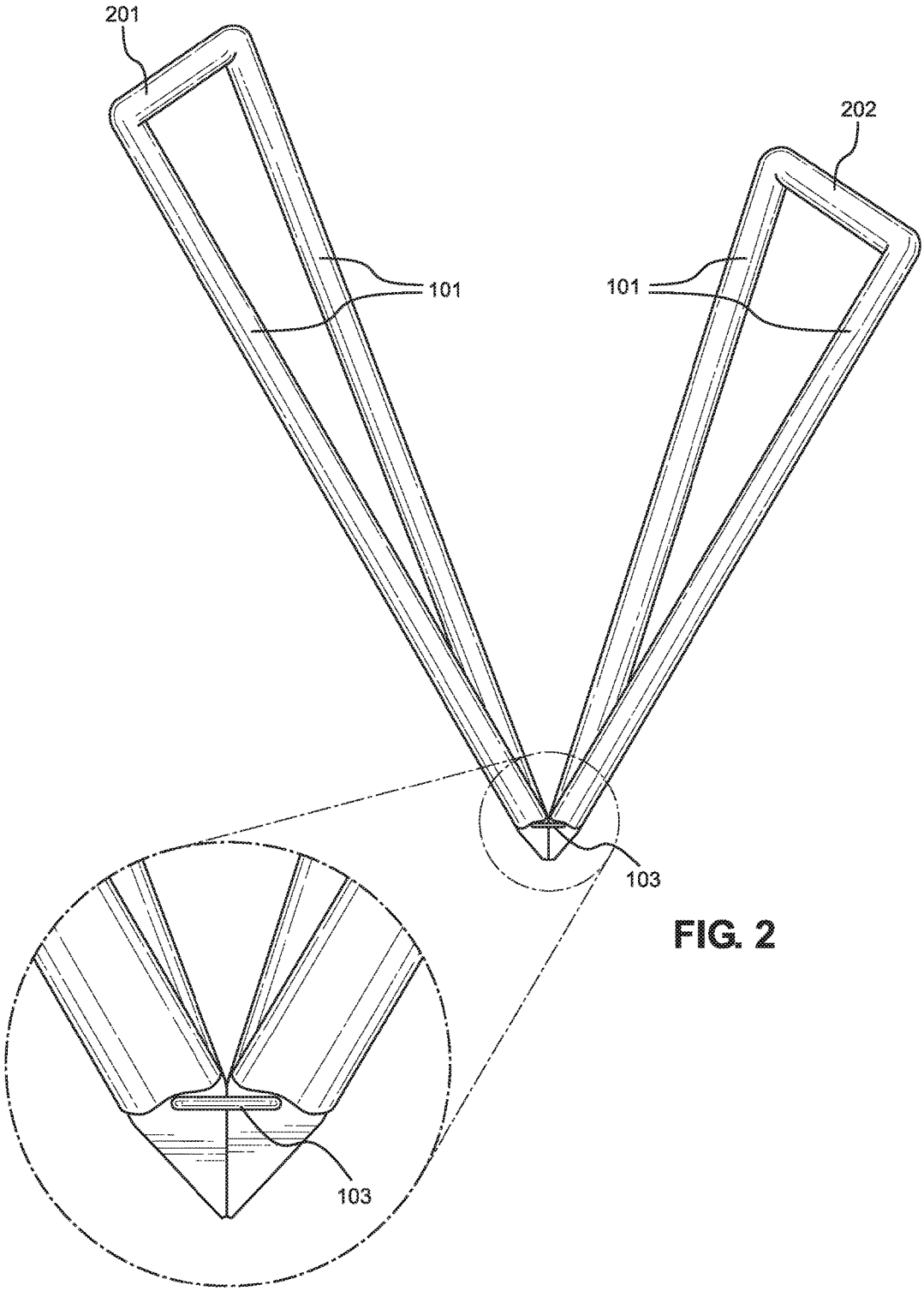
FIG. 2 shows a side view of an embodiment of the all-terrain lounge chair in an open configuration without the seat attached.
Figure 3:
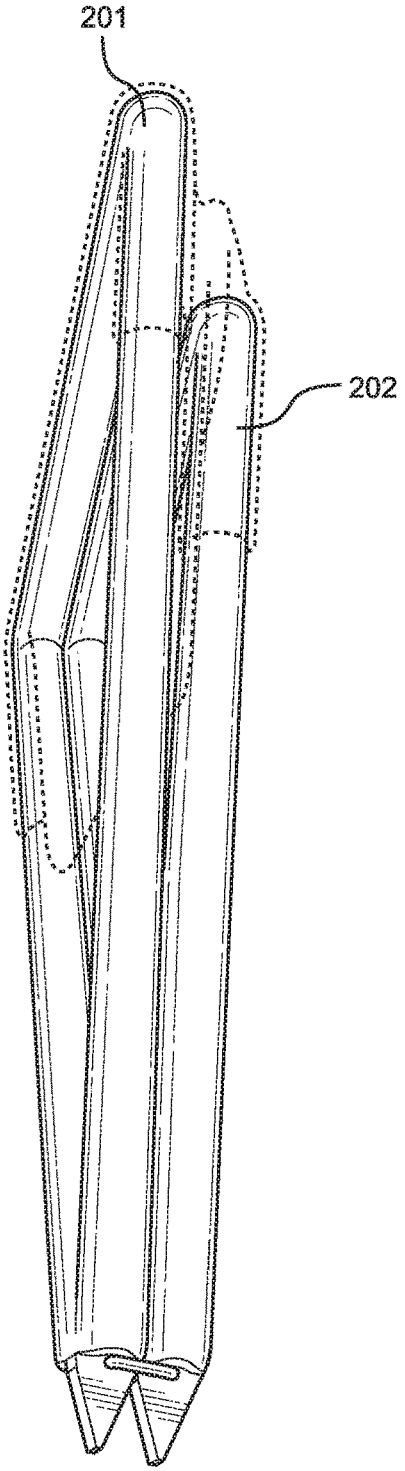
FIG. 3 shows a side view of an embodiment of the all-terrain lounge chair in a folded configuration without the seat attached.

Referring to FIG. 2 and FIG. 3, there is shown a side view of an embodiment of the all-terrain lounge chair in an open configuration and a folded configuration without the seat attached. The plurality of legs 101 can be attached with cross bars 201, 202. There may be a rear cross bar 201 and a front cross bar 202. These cross bars will allow the legs to stay separated. This configuration will form triangular supports. Further, the chair may be able to go from a deployed position to a flat folded position. This will allow the chair to be portable. Referring to FIG. 2 in one embodiment the legs are a fixed with a connector. In one embodiment the connector is a length of rope 103. This can be done by placing the rope through holes in the legs. In another embodiment the connector is a hinge. In another embodiment the connector is a pin.

Figure 4:
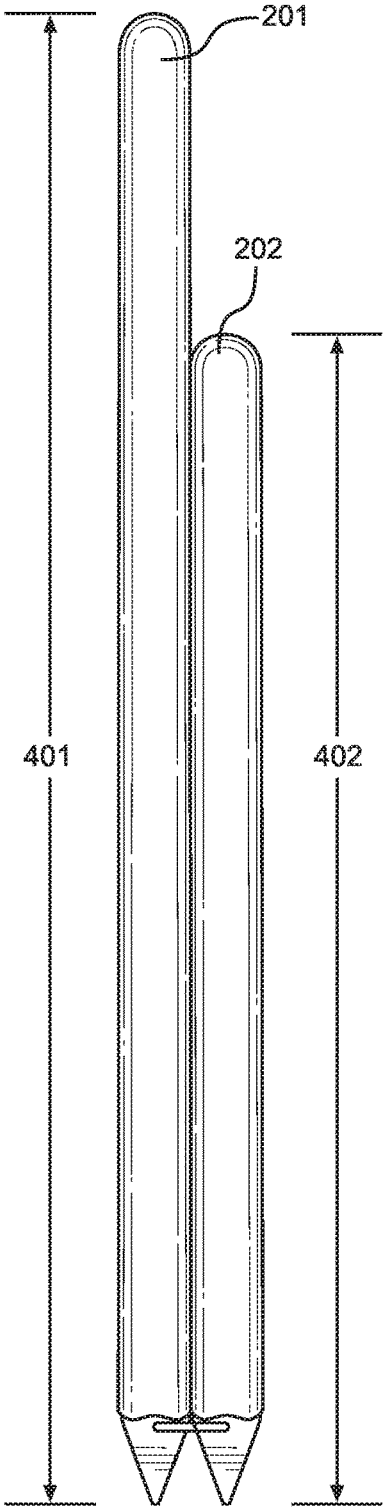
FIG. 4 shows a perspective view of an embodiment of the all-terrain lounge chair in a folded configuration.

Referring to FIG. 4, there is shown a perspective view of an embodiment of the all-terrain lounge chair in a folded configuration. In this view it can be seen that the rear cross bar 201 may be higher than the front cross bar 202. Some of the legs may be longer than the others to achieve this effect. This will allow the chair to have a back portion 401 and a front portion 402. This will allow a person to be able to sit comfortably in the chair.

Figure 5:
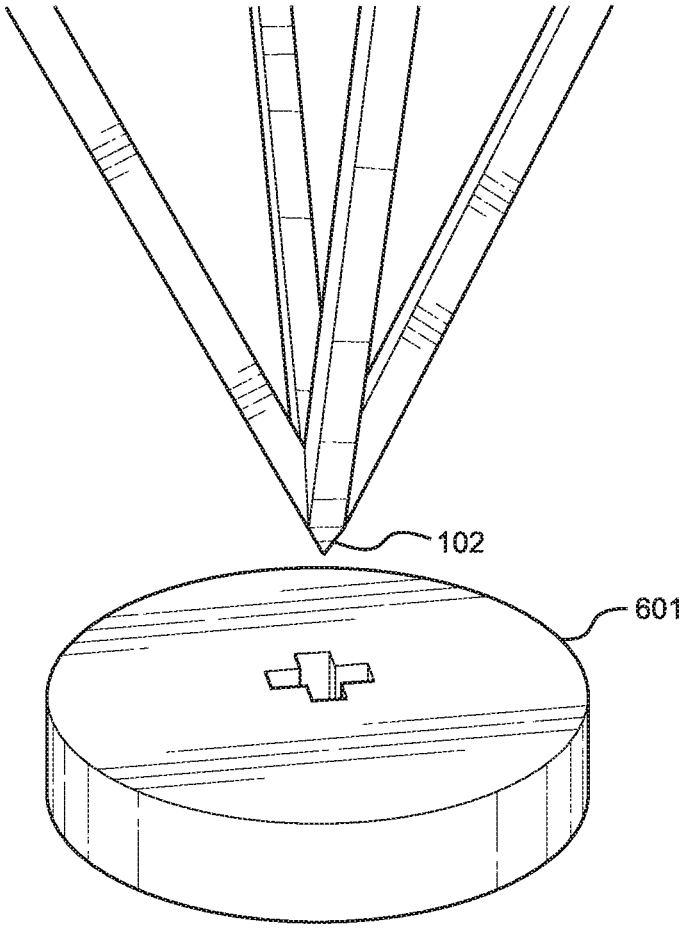
FIG. 5 shows a zoomed view of an embodiment of the all-terrain lounge chair in an open configuration and a base.

Referring to FIG. 5, there is shown a zoomed view of an embodiment of the all-terrain lounge chair in an open configuration and a base. A base 601 may be configured to accept the apex 102 of the chair. The base may be a portable base. This will allow the chair to be used on a hard surface or indoors. In a second embodiment the base 601 may be configured to attach to the base member 503. The base may be filled with a heavy material to help balance the chair.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An all-terrain lounge chair, comprising:

a first support and a second support, wherein the first support is taller than the second support;

wherein the first support and the second support are triangles, wherein an apex of the first support and an apex of the second support are at the bottom of the first support and the second support, respectively;

wherein the apexes of the first support and the second support are movably attached together forming a single apex;

a seat portion attached to the first support and the second support opposite the single apex.

2. The all-terrain lounge chair of claim 1, wherein the first support and the second support are attached with a rope at the single apex.

3. The all-terrain lounge chair of claim 1, wherein the first support and the second support are attached with a pin at the single apex.

4. The all-terrain lounge chair of claim 1, wherein the all-terrain lounge chair is foldable.

5. The all-terrain lounge chair of claim 1, further comprising a base configured to accept the single apex.

* * * * *